US008134294B2

(12) United States Patent
Jansma

(10) Patent No.: US 8,134,294 B2
(45) Date of Patent: Mar. 13, 2012

(54) LOW PRESSURE DISCHARGE LAMPS WITH COATED INNER WIRES FOR IMPROVED LUMEN MAINTENANCE

(75) Inventor: Jon Bennett Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/786,851

(22) Filed: May 25, 2010

(65) Prior Publication Data

US 2011/0291546 A1 Dec. 1, 2011

(51) Int. Cl.
*H01J 5/32* (2006.01)
*H01J 61/067* (2006.01)

(52) U.S. Cl. ..... 313/626; 313/492; 313/631; 313/42

(58) Field of Classification Search ..... 313/623, 313/42–43, 485–486, 626, 491, 492, 631
See application file for complete search history.

(56) References Cited

U.S. PATENT DOCUMENTS

| | | | | |
|---|---|---|---|---|
| 2,769,112 | A | 10/1956 | Heine | |
| 3,069,580 | A | 12/1962 | Waymouth | |
| 3,706,895 | A | 12/1972 | Martyny | |
| 3,826,946 | A | 7/1974 | Hammer | |
| 4,204,137 | A | 5/1980 | Roy | |
| 4,739,219 | A * | 4/1988 | Hume | 313/623 |
| 4,870,323 | A | 9/1989 | Parks | |
| 6,603,249 | B2 | 8/2003 | Garner | |
| 6,603,250 | B2 | 8/2003 | Shaffer | |
| 2003/0155858 | A1 | 8/2003 | Cunkelman | |

* cited by examiner

*Primary Examiner* — Karabi Guharay
(74) *Attorney, Agent, or Firm* — Global Patent Operation

(57) ABSTRACT

Disclosed herein is a low pressure discharge lamp having a coating disposed upon at least a portion of inner lead-in wires, wherein the coating comprises refractory nanoparticles. Also disclosed herein, in particular, are fluorescent lamps having a coating disposed upon at least a portion of inner lead-in wires, the coating comprising refractory oxide nanoparticles having a median primary particle size of less than about 70 nm, with a thickness of from about 0.5 micrometer to about 10 micrometer. Disclosed advantages may include lessened end discoloration over the operational lifetime of the lamp, enhanced lumen maintenance, and inhibited mercury consumption.

20 Claims, 3 Drawing Sheets

LOW PRESSURE DISCHARGE LAMPS WITH COATED INNER WIRES FOR IMPROVED LUMEN MAINTENANCE

FIELD OF THE INVENTION

The present invention generally relates to low pressure discharge lamps with improved lumen maintenance. In particular, some embodiments herein relate to low pressure discharge lamps with inner lead-in wires having a coating of refractory nanoparticles.

BACKGROUND

Many known fluorescent lamps utilize a low-pressure buffered mercury discharge to produce ultraviolet light, which is converted to visible light by a phosphor coating. Mercury vapor is generally required for the successful and efficient operation of many conventional fluorescent lamps. However, for enhanced environmental compliance, there are steady efforts to reduce the amount of mercury per lamp. Some new lamp designs may require performance under the constraint of mercury levels in the range of about 1 mg or less per lamp. To achieve this, it is important to ensure that lamp components perform with minimal reactions with the mercury in the gaseous fill, in order to reduce binding of mercury with other components of the lamp. Such may result in premature lamp failure. Typically, lamp electrodes may act as sites for mercury binding due to interactions between mercury and the electrode components. Furthermore, electrodes may suffer sputtering of their emissive mixture to form deposits on the interior of a lamp envelope during lamp operation, which deposits may bind additional mercury.

The electrode of fluorescent lamps operating on alternating current act alternative in an anode and a cathode mode. Owing to anode current passage to the electrode lead wires in fluorescent lamps, the following may occur: end discoloration, mercury loss, and lamp failure. This can be problematic, especially with an increased emphasis on longer life specification and lower mercury content in lamps.

It remains desirable to develop and implement low pressure discharge lamps which overcome the problems noted above.

BRIEF SUMMARY OF THE INVENTION

One embodiment of the present invention is directed to a low-pressure discharge lamp, comprising light-transmissive envelope, fill gas composition capable of sustaining an electric discharge sealed inside the light-transmissive envelope, and one or more stem at least partially disposed within the envelope. Spaced-apart lead-in wires extend from the one or more stem, and an electrode extends between the lead-in wires. A coating is disposed upon at least a portion of the lead-in wires, which coating comprising refractory nanoparticles.

A further embodiment of the present invention is directed to a fluorescent lamp, comprising light-transmissive envelope, fill gas composition capable of sustaining an electric discharge sealed inside the light-transmissive envelope, and one or more stem at least partially disposed within the envelope. Spaced-apart lead-in wires extend from the one or more stem, and an emissive electrode extends between the lead wires. Further, a coating is disposed upon at least a portion of the lead-in wires, which coating comprises refractory oxide nanoparticles, wherein the refractory oxide nanoparticles have a median primary particle size of less than about 70 nm, and wherein the coating has a thickness of from about 0.5 micrometer to about 10 micrometer.

Other features and advantages of this invention will be better appreciated from the following detailed description.

BRIEF DESCRIPTION OF THE DRAWINGS

Embodiments of the invention will now be described in greater detail with reference to the accompanying Figures.

DETAILED DESCRIPTION

Figure 1:
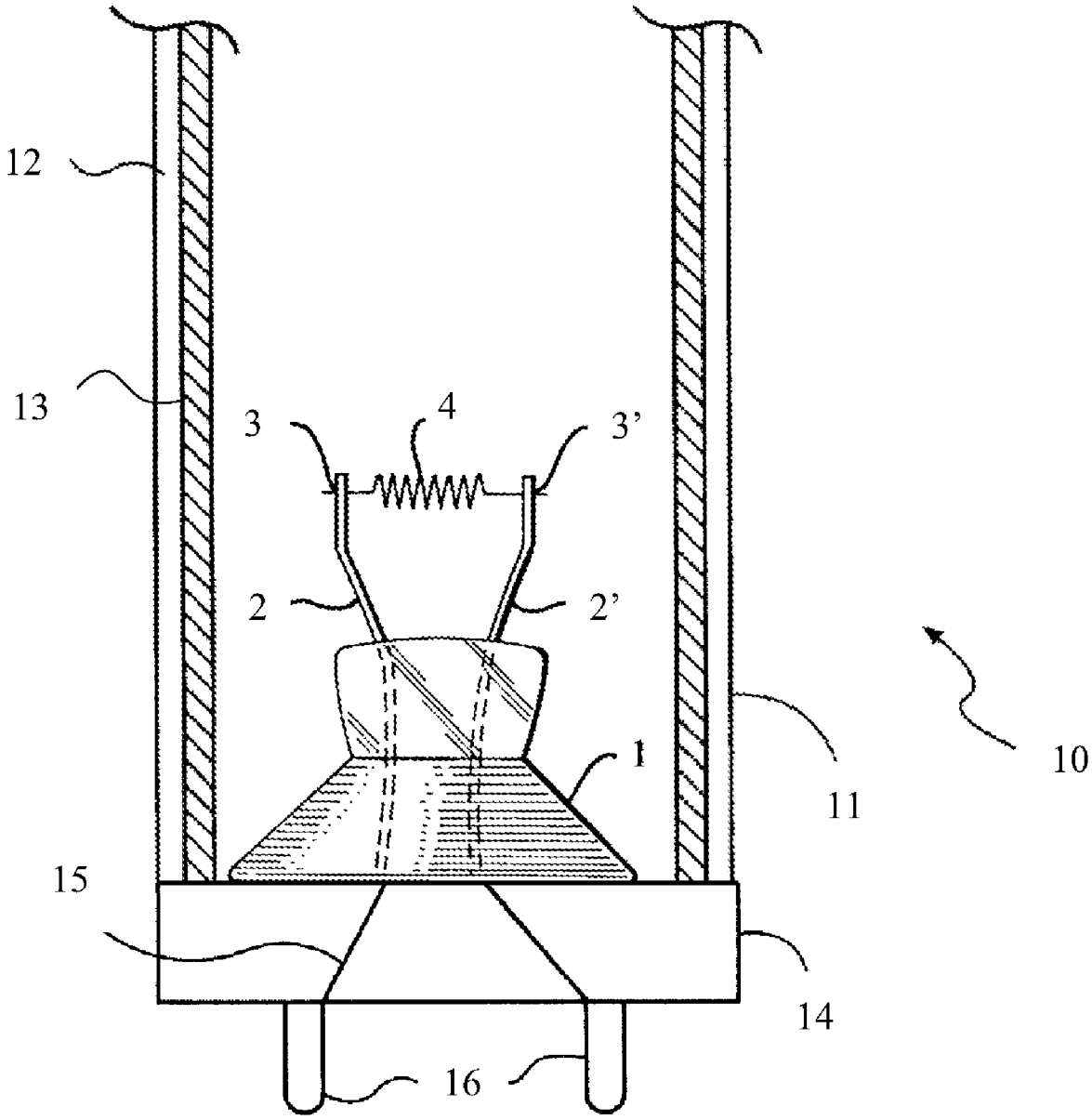
FIG. 1 is a schematic cut-away depiction of a typical fluorescent lamp in accordance with an embodiment of the invention.

In accordance with embodiments, the present invention generally relates to low-pressure discharge lamps, such as fluorescent lamps. It is contemplated to be within the scope of the disclosure to utilize the coatings and methods disclosed herein, in a wide variety of lamps, including mercury fluorescent lamps, low dose mercury, very high output fluorescent, and mercury free low-pressure fluorescent lamps. Examples of such fluorescent lamps include linear fluorescent lamps of the types T8, T5, T12, F32T8 or the like; or may include compact fluorescent lamps (CFL). Generally, the low-pressure discharge lamps will comprise at least one light-transmissive envelope, which can be made of a vitreous (e.g., glass) material and/or ceramic, or any suitable material which allows for the transmission of at least some visible light. These lamps will comprise a fill gas composition capable of sustaining an electric discharge, which is sealed inside the at least one light-transmissive envelope.

Typically, the low pressure discharge lamp will contain at least one electrode capable of energizing the discharge by electron emission. In accordance with the invention, the lamps will contain one or more stem at least partially disposed within the envelope, with spaced-apart lead-in wires extending from the one or more stem. The at least one electrode noted above will extend between the lead-in wires. Generally, the stem may act to mechanically support the electrode and lead-in wires, as well may act to hermetically seal the envelope. Usually, the stem may be electrically insulating and generally may be constructed of a material which has a thermal coefficient of expansion compatible with the envelope. In some embodiments, the stem may be a glass "stem press", which includes a glass pinch seal for sealing the spaced-apart lead-in wires connected to the electrode.

The lead-in wires may be in electrical communication with a source of electrical current to energize the lamp. Generally, this may be accomplished by extending an inner portion of each lead-in wire (i.e., the portion inside the envelope) through the stem to an outer portion of the lead-in wire on the outside of the envelope which is in electrical communication with an electrically conductive base pin (pref., metallic). As is conventionally known in the field, the low pressure discharge lamp may be provided by ballast and/or electronic circuitry, which may function to regulate the operation of the lamp.

In accordance with the disclosure, a coating comprising refractory nanoparticles will be disposed upon at least a portion of the lead-in wires. In general, at least one of the following parameters will be adapted or chosen so as to be effective to inhibit end discoloration of the low pressure discharge lamp when in operation, and/or to enhance the maintenance of lumen levels during the operational lifetime of the low pressure discharge lamp: (1) the composition of the refractory nanoparticles used in the coating; (2) the size of the refractory nanoparticles; (3) the thickness of the coating; and (4) the location of the coating on the lead-in wires. For lamps where the fill gas composition comprises Hg, the composition of the refractory nanoparticles used in the coating, the size of the refractory nanoparticles, the thickness of and location of the coating may also be adapted so as to inhibit consumption of mercury in the fill gas.

Such coating may minimize consumption of mercury (caused by, e.g., mercury reactions with the lead wires), and may minimize the formation of dark deposits on the fluorescent lamp inner bulb wall, near the ends. The coatings for the lead-in wires described in this disclosure can significantly reduce mercury loss at lamp ends, thus extending life or reducing the required initial level of mercury per lamp.

In some embodiments, such refractory nanoparticles may have a size in the colloidal range. In some embodiments, such refractory nanoparticles may have a median primary particle size of less than about 500 nm, or more particularly, have a median primary particle size of less than about 70 nm, preferably of from about 10 nm to about 70 nm. As is generally known to those of ordinary skill in the field, primary particle diameter and its distribution can be analyzed by TEM (transmission electron microscopy), which is a standard method for particle analysis. It provides different relevant size parameters like primary particle diameter, aggregate and agglomerate size. Also, as is also generally known, primary particle size distributions can be determined accurately by statistical evaluation of a large number of particles.

Some suitable refractory nanoparticles may comprise refractory oxide nanoparticles, such as refractory metal (or metalloid) oxide nanoparticles. For example, a nonlimiting list of suitable materials for refractory oxide nanoparticles may include alumina, yttria, zirconia, silica, zinc oxide, and combinations thereof; or the like.

In accordance with embodiments of the disclosure, the coating comprising refractory nanoparticles may have a thickness of from about 0.5 micrometer to about 10 micrometer, more narrowly, from about 1 micron to about 5 microns. Embodiments of the present disclosure may advantageously employ coatings which are clear, dense, and uniform, although such is not always required. Generally, the coating will be insulating or dielectric. In contrast with some previously known coatings of lead-in wires, the coatings of the lead-in wires in accordance with embodiments of the invention may be simultaneously thinner (e.g., less than about 10 micrometer thick) and composed of smaller primary particles (that is, nanoparticles having, for example, a median primary particle size of less than about 500 nm).

In some embodiments, the coating of refractory nanoparticles may be disposed upon substantially all of a surface of the inner lead-in wires, located between the stem and the electrode within the interior of the envelope. That is, the entire inner lead may be coated, from the stem press, up to and possibly including the "hook" which holds the electrode. Alternatively, the coating may be substantially disposed only on a hook region of said inner lead-in wires, although this is generally less preferred.

The coating of the lead-in wires may be carried out by any one or more of a variety of coating processes. In embodiments, the coating material can applied in a liquid phase, as for example, a slurry, suspension, or a solution. In such embodiments, one may suitably employ coating methods such as electrostatic painting, brushing, dipping, spraying, pouring, rolling, spin-coating, laminating, injecting, flow-coating, knife-coating, sprinkling, or combinations of the foregoing; or the like. In other embodiments, the coating material of the lead-in wires may be applied by vapor phase deposition methods such as plasma spray-based deposition, chemical vapor deposition; or the like.

The coating of the lead-in wires may be applied prior to, or after, the metallic electrode (e.g., tungsten coil) is clamped in or otherwise supported between the lead-in wires. However, the lead-in wires may be coated at any stage in electrode or wire manufacture. One convenient way is to apply coating to lead-in wires after they have been mounted in the stem, but prior to connection of the emissive electrode.

In accordance with embodiments of the invention, the lead-in wires may include a metal selected from Ni, Fe, and combinations thereof; or the like. For example, at least one of the lead-in wires may be a metallic combination of Ni and Fe, such as Ni-plated iron. Alternatively, the lead-in wires may be composed of another metal (e.g., copper) which is coated (or plated) with at least one of Ni, Fe, and combinations thereof.

As noted above, low pressure discharge lamps in accordance with the present invention will comprise at least one electrode. Often, such electrode will be mounted upon said lead-in wires, such as being disposed (e.g., clamped) longitudinally between said lead-in wires. The electrode usually will comprise an electrode substrate comprising a metallic material selected from the group consisting of W, Ta, Pt, Th, Ti, Ni, V, Hf, Nb, Mo, Zr, Re, and combinations and alloys thereof; or the like. The electrode substrate may have any desired shape. It may be one-dimensional, two-dimensional or three-dimensional or any suitable fractional dimension up to about 3. Suitable examples of one-dimensional substrate are linear filaments, non-linear filaments such as circular filaments, elliptical filaments, coiled filaments or the like. Coiled electrodes comprising a tungsten filamentary substrate may suitably be employed. Importantly, the electrode should function as an emissive electrode, e.g., thermionic emission. To promote this, an emissive electrode comprises an electron emissive material in addition to the metallic substrate. In some embodiments, the electron emissive material may comprise one or more of Ba, Sr and Ca, such as one or more oxides of Ba, Sr and/or Ca. Other substances which may be present in admixture with such emissive materials include one or more of metallic materials, metal oxides, mixed metal oxides, metal alloys, ferroelectric materials, or the like.

Some non-limiting examples of materials which may comprise the discharge fill of lamps include at least one material selected from the group consisting of Hg, Na, Zn, Mn, Ni, Cu, Al, Ga, In, Tl, Sn, Pb, Bi, Ti, V, Cr, Zr, Nb, Mo, Hf, Ta, W, Re, Os, Ne, Ar, He, Kr, Xe and combinations and compounds thereof; or the like. In one embodiment, the discharge fill material in a lamp includes mercury. In another embodiment, the discharge fill material in a lamp is mercury free. In particular, where a substantially mercury-free discharge fill is desired, the discharge fill may comprise at least one material selected from the group consisting of a gallium halide, a zinc halide and an indium halide; or the like. The fill will be present at any effective pressure, e.g., a pressure effective to sustain a low-pressure discharge, as can be readily ascertained by any person skilled in the field. Some suitable pressures may comprise a total fill pressure of from about 0.1 to about 30 kPa; other values are possible as well.

Generally, low pressure discharge lamps in accordance with embodiments of the invention will have at least one phosphor composition carried on said light-transmissive envelope, e.g., on an inner surface of said light-transmissive envelope. As is generally well known, phosphor compositions convert the electromagnetic radiation emanating from the discharge into desired wavelengths, usually of lower energy. In embodiments where the lamp has multiple envelopes, the light-transmissive envelope upon which is disposed a phosphor composition may be an inner envelope.

Referring now to the drawing with greater particularity, there is shown in FIG. 1 a cut-away schematic view of a typical linear fluorescent lamp 10 having an evacuated, electromagnetic-energy-transmissive envelope 11. In the embodiment of FIG. 1, the inner surface of envelope 11 bears an alumina layer 12 carrying at least one phosphor composition 13. In particular, this Figure depicts a stem 1 which hermetically seals envelope 11, and from which inner lead-in wires 2 and 2' extend. At hook regions 3 and 3', a coiled emissive tungsten electrode 4 is mounted. In at least the portion between hook regions 3 and 3' and the point from which inner lead-in wires 2 and 2' protrude from stem 1, the coatings according to embodiments of the invention (not specifically shown) are deposited. Inner lead wire 2 (as well as 2') is in electrical communication with outer lead wire 15 which extends through base 14 into communication with base pin 16.

Coating the lead-in wires with coatings according to embodiments of the invention may accomplish several key lamp operation improvements. The prevention of anode current directly occurring on the lead-in wire may prevent heating of the wire, with corresponding release of gaseous impurities common wires such as drawn steel wires. Also, by forcing the current to pass through the metallic (e.g., tungsten) portion of the electrode assembly, the emitting (cathode half cycle) may be more efficient, improving emissivity when acting in the cathode cycle. By providing a suitably dense, inert coating over the metallic lead-in wire, the tendency to react with mercury vapor is minimized. Thus, the embodiments of the invention goal may improve the efficiency of the operation of the tungsten electrode operation, minimize heating and outgassing of the lead wire, and minimize Hg reactions with the lead wires.

The lead-in coating proposed in this disclosure provides a significant improvement in electrode operation with minimal cost addition. The electrode lead coating claimed in this disclosure provides a practical method to reduce mercury consumption in the end region of fluorescent lamps.

In order to promote a further understanding of the invention, the following examples are provided. These examples are illustrative, and should not be construed to be any sort of limitation on the scope of the claimed invention.

EXAMPLES

Example 1

A solution or sol suspension of various nanosized oxide particles was prepared. The oxides which were tested were alumina, yttria, zirconia, and silica. Nanosized oxide particles of these types are well known and generally commercially available, or can be prepared by conventional methods. Some suitable forms in which these can be obtained or made include colloidal solutions and sol suspensions. These particles were dispersed in water containing trace levels of fugitive additives (ammonia or acetic acid), which function to enhance dispersion. In more detail, a solution/sol of yttria nanoparticles was prepared was by the following method. Initially, a mixture of deionized water (60 wt %), finely divided yttrium oxide (39 wt %), acetic acid, and a nonionic nonylphenylethoxylate-type surfactant (IGEPAL CO530, trade name of Rhodia, Inc.) was prepared. Surfactant concentration was approximately 1000 ppm (mg surfactant/liter of coating solution). Surfactant can lower surface tension and help wet metal wires. The mixture was subsequently milled in a bead mill to achieve complete dispersion of the yttria in the water/surfactant solution. The dispersion was diluted in a manner effective to provide a suitable application viscosity and achieve a surface coverage of ca. 1 micrometer thickness when coating the lead-in wires. One may substitute mild bases for the acetic acid to achieve higher pH, if needed for other nanoparticles such as $SiO_2$ or $ZrO_2$. Many other types of surfactants, both non-ionic and ionic can be selected for surface tension reduction. Alumina, zirconia, silica, and blends were prepared as nanoparticle sols in a similar manner.

Example 2

In these examples, the nanosized oxide particle dispersions were applied to the electrode inner lead wires, using a brush or spray process, to cover substantially the whole of the inner lead-in wires, from the glass stem to the clamp which holds the tungsten electrode. Care was taken not to apply the coating to the conducting portion of the tungsten electrode (between the clamps) but in these examples, coating was applied to the excess tungsten coil protruding from the outside of the clamp region. The coatings were air dried, without the necessity of baking or other heat treatment. The resulting coatings were clear, dense, and uniform. Generally, by these methods, coatings of thickness varying from 100-5000 nm could be obtained, but it was most preferable to use coatings of 1000 nm thickness.

Example 3

A test was conducted on two sets of typical linear fluorescent lamps (F32T8), wherein one set of six lamps were assembled having a lead-in wires coated by the nanosize yttria particles made by Example 1. Coating was accomplished according to the procedure of Example 2. These inventive lamps were tested and the results of the tests were denoted as "Cell C". For comparative reference, six control lamps were assembled having no coating on the lead-in wires, and the results from testing these uncoated lamp were denoted as "Cell A".

Figure 2A:
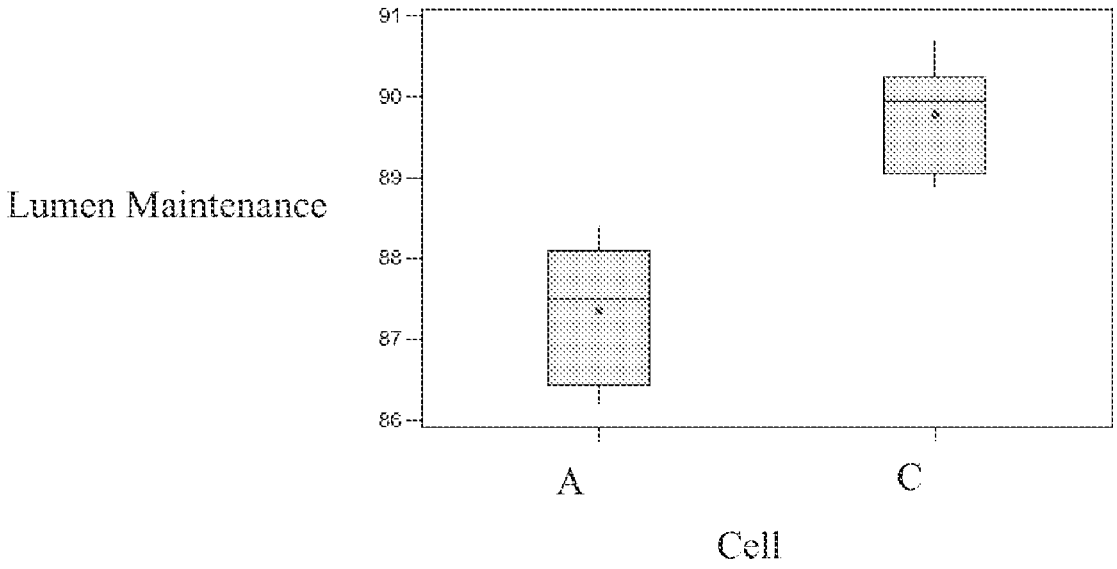
FIG. 2A and FIG. 2B are plots of lumen maintenance and end discoloration, respectively, for lamps in accordance with embodiments of the invention as compared to controls.
Figure 2B:
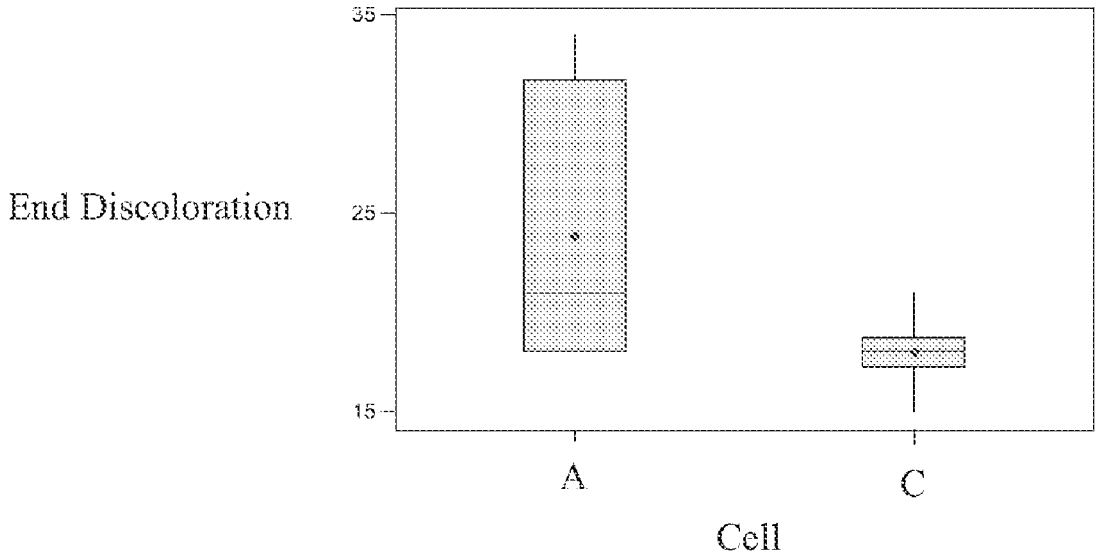

FIG. 2A is a comparison of the lumen maintenance for each set of lamps after 8000 hours of use. It can be seen that the average 8000 h lumen maintenance for the lamps with uncoated leads of Cell A was around 87%, while the lumen maintenance tests conducted under the same conditions but for Cell C was around 90%. The mean values are denoted in FIG. 2A by the dot in the middle of the box plot. The data sets are non-overlapping, indicative of the significance of the improvement. FIG. 2B is a comparison of the end discoloration of the lamps after 8000 hours. Again, Cell C shows improvement in end discoloration (ED), with a mean ED as adjudged by the subjective test of around 16 vs. around 25 for that of the uncoated lamps of Cell A.

The degree of end discoloration of fluorescent lamps may be quantified numerically by an optical rating system, utilizing an arbitrary scale. A detailed procedure, including visual standards, is provided to trained technicians to perform the end discoloration readings of lamps during the life testing procedure. It is typically found that as a linear fluorescent lamp attains an end-of-life state, the degree of end discoloration is found to be in the range of from about 10-15. Higher values indicate lamp design or operation issues. A completely darkened end with a "saturated" reading would rank at about 50. One non-limiting cause of end discoloration may be bound mercury, i.e., mercury lost from the fill and depositing in some form on the envelope, which results in the black or darkened appearance.

Example 4

Figure 3A:
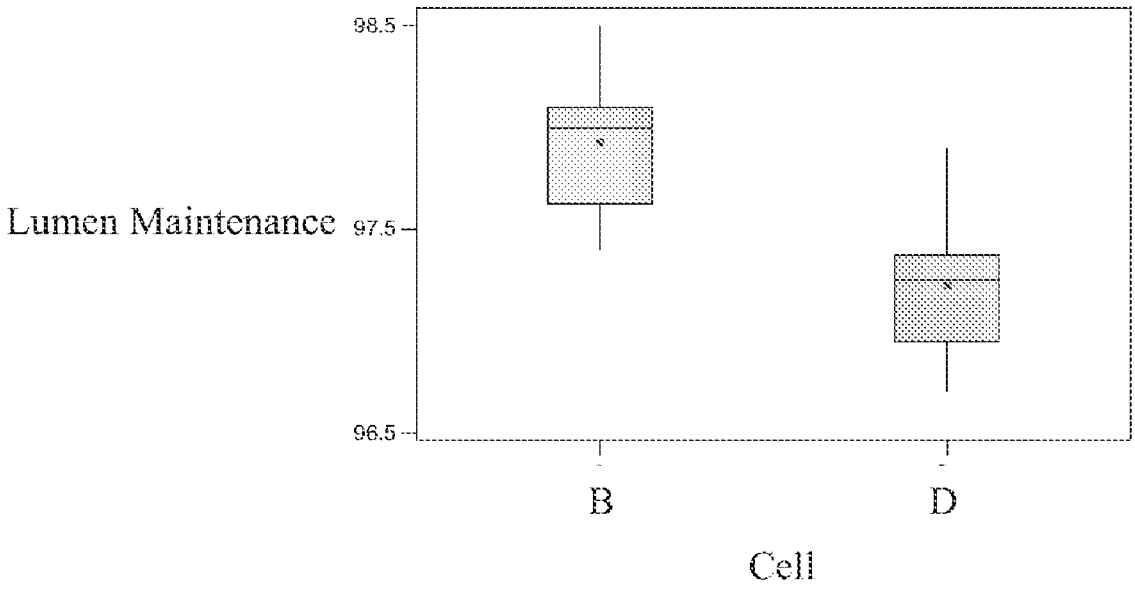
FIG. 3A and FIG. 3B are plots of lumen maintenance and end discoloration, respectively, for further lamps in accordance with embodiments of the invention as compared to controls.
Figure 3B:
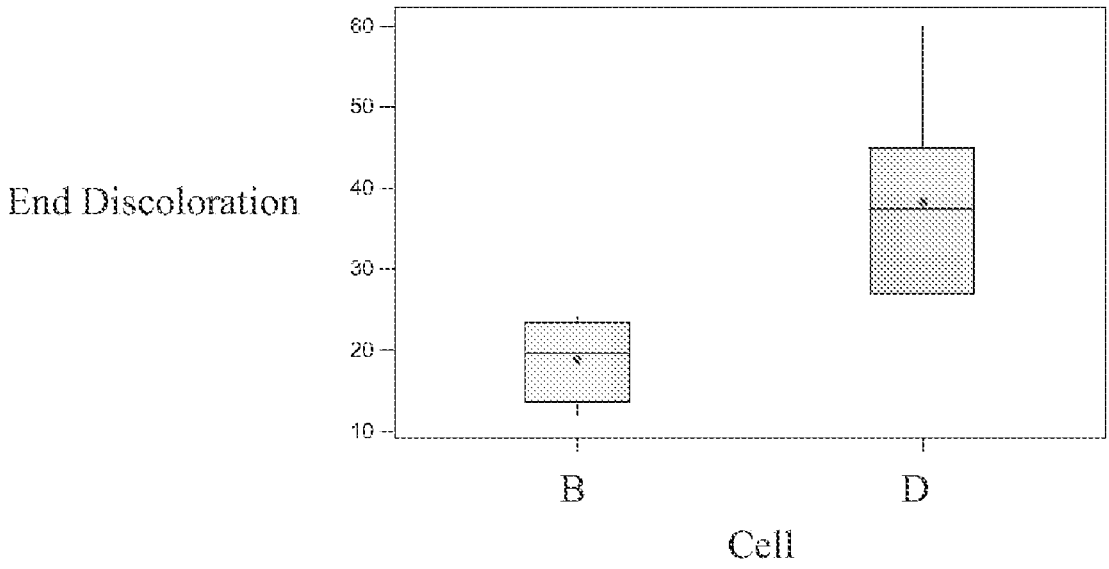

Another test was conducted on two sets of typical linear fluorescent lamps (F32T8), with one set of eight lamps assembled having a lead-in wires being coated by nanosize alumina particles (made by a method analogous to Example 1), and coated according to the procedure of Example 2. These inventive lamps were tested, and the results of the tests were denoted as "Cell B". For comparative reference, eight control lamps were assembled having no coating on the lead-in wires, and the results from testing these uncoated lamp were denoted as "Cell D". As seen in FIG. 3A and FIG. 3B, respectively, the 3000 h lumen maintenance and end discoloration (ED) was significantly improved from the inventive lamps of Cell B vs. those of Cell D.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. It is also anticipated that advances in science and technology will make equivalents and substitutions possible that are not now contemplated by reason of the imprecision of language and these variations should also be construed where possible to be covered by the appended claims.

What is claimed as new and desired to be protected by Letters Patent of the United States is:

1. A low-pressure discharge lamp, comprising:

light-transmissive envelope;

fill gas composition capable of sustaining an electric discharge sealed inside the light-transmissive envelope, and one or more stem at least partially disposed within the envelope;

spaced-apart lead-in wires extending from the one or more stem, and an electrode extending between said lead-in wires;

a coating disposed upon at least a portion of said lead-in wires, said coating comprising refractory nanoparticles.

2. The lamp in accordance with claim 1, wherein the composition of refractory nanoparticles, refractory nanoparticle size, and thickness of coating are configured to inhibit end discoloration and enhance lumen maintenance.

3. The lamp in accordance with claim 1, wherein the refractory nanoparticles have a median primary particle size of less than about 500 nm.

4. The lamp in accordance with claim 3, wherein the refractory nanoparticles have a median primary particle size of from about 10 nm to about 70 nm.

5. The lamp in accordance with claim 1, wherein said coating has a thickness of from about 0.5 micrometer to about 10 micrometer.

6. The lamp in accordance with claim 1, wherein said refractory nanoparticles comprise at least one of metal oxides and metalloid oxides.

7. The lamp in accordance with claim 6, wherein said refractory nanoparticles comprise at least one selected from the group consisting of alumina, yttria, zirconia, silica, zinc oxide, and combinations thereof.

8. The lamp in accordance with claim 1, wherein at least one phosphor composition is carried on an inner surface of said light-transmissive envelope.

9. The lamp in accordance with claim 1, wherein said lamp is a linear fluorescent lamp or compact fluorescent lamp.

10. The lamp in accordance with claim 1, wherein the electrode is a coiled metallic filament comprising an emissive composition.

11. The lamp in accordance with claim 1, wherein the lead-in wires include a metal selected from Ni, Fe, and combinations thereof.

12. The lamp in accordance with claim 1, wherein the lead-in wires are inner lead-in wires, and wherein the coating is disposed upon substantially all of a surface of the inner lead-in wires between the stem and the electrode within the interior of the envelope.

13. The lamp in accordance with claim 1, wherein said fill gas composition comprises Hg.

14. The lamp in accordance with claim 1, wherein said refractory nanoparticles comprise at least one selected from the group consisting of alumina, yttria, silica, zinc oxide, and combinations thereof.

15. A fluorescent lamp, comprising:

light-transmissive envelope;

fill gas composition capable of sustaining an electric discharge sealed inside the light-transmissive envelope, and one or more stem at least partially disposed within the envelope;

spaced-apart lead-in wires extending from the one or more stem, and an emissive electrode extending between said lead wires;

a coating disposed upon at least a portion of said lead-in wires, said coating comprising refractory oxide nanoparticles, wherein the refractory oxide nanoparticles have a median primary particle size of less than about 70 nm, and wherein the coating has a thickness of from about 0.5 micrometer to about 10 micrometer.

16. The lamp in accordance with claim 15, wherein the refractory oxide nanoparticles comprise at least one selected from the group consisting of alumina, yttria, zirconia, silica, zinc oxide, and combinations thereof.

17. The lamp in accordance with claim 15, wherein the lead-in wires include a metal selected from Ni, Fe, and combinations thereof.

18. The lamp in accordance with claim 15, wherein said fill gas composition comprises Hg.

19. A low-pressure discharge lamp, comprising:

light-transmissive envelope;

fill gas composition capable of sustaining an electric discharge sealed inside the light-transmissive envelope, and one or more stem at least partially disposed within the envelope;

spaced-apart lead-in wires extending from the one or more stem, and an electrode extending between said lead-in wires;

a coating disposed upon at least a portion of said lead-in wires, said coating consisting essentially of refractory nanoparticles.

20. A low-pressure discharge lamp, comprising:

light-transmissive envelope;

fill gas composition capable of sustaining an electric discharge sealed inside the light-transmissive envelope, and one or more stem at least partially disposed within the envelope;

spaced-apart lead-in wires extending from the one or more stem, and an electrode extending between said lead-in wires;

a coating disposed upon at least a portion of said lead-in wires, said coating comprising refractory nanoparticles, wherein said coating has been disposed by applying a solution or sol suspension of refractory nanoparticles to at least a portion of said lead-in wires.

* * * * *